US006538646B2

(12) United States Patent
Konuta et al.

(10) Patent No.: US 6,538,646 B2
(45) Date of Patent: Mar. 25, 2003

(54) IMAGE DISPLAY APPARATUS FOR EFFICIENTLY IMPLEMENTING THE REDUNDANT DISPLAY OF IMAGES

(75) Inventors: Susumu Konuta, Tokyo (JP); Toshiya Kaihoko, Tokyo (JP); Natsuo Ito, Kanagawa (JP); Masayo Narato, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/503,038

(22) Filed: Feb. 11, 2000

(65) Prior Publication Data

US 2002/0180715 A1 Dec. 5, 2002

(30) Foreign Application Priority Data

Feb. 15, 1999 (JP) ..... 11-036234

(51) Int. Cl.[7] ..... G09G 5/00
(52) U.S. Cl. ..... 345/204; 345/536; 345/538
(58) Field of Search ..... 345/156–157, 345/905, 903, 629, 536, 537, 538, 544, 204; 710/310

(56) References Cited

U.S. PATENT DOCUMENTS

| | | | | | |
|---|---|---|---|---|---|
| 4,972,068 | A | * | 11/1990 | Ohtani et al. | 235/375 |
| 5,583,539 | A | * | 12/1996 | Hiketa et al. | 345/823 |
| 5,713,033 | A | * | 1/1998 | Sado | 707/534 |
| 5,861,873 | A | * | 1/1999 | Kikinis | 345/157 |
| 5,900,865 | A | * | 5/1999 | Howe | 345/572 |
| 5,986,633 | A | * | 11/1999 | Takeuchi | 345/629 |

* cited by examiner

*Primary Examiner*—Steven Saras
*Assistant Examiner*—Amr Awad
(74) *Attorney, Agent, or Firm*—Frommer Lawrence & Haug LLP; William S. Frommer; Bruno Polito

(57) ABSTRACT

The object of the present invention is to provide an image display apparatus suited to display a video program or the like for advertisement purposes. The image display apparatus comprises a storage medium installation section (11), a memory section (13) storing image data read out from a storage medium (1) installed into the storage medium installation section (11), a display section (16) displaying the image data stored in the memory section (13) and a control section (19) for repeatedly executing display of the image data stored in the memory section (13) at the display section (16).

6 Claims, 5 Drawing Sheets

IMAGE DISPLAY APPARATUS FOR EFFICIENTLY IMPLEMENTING THE REDUNDANT DISPLAY OF IMAGES

BACKGROUND OF THE INVENTION

1. Field of the Invention

The present invention relates to an image display apparatus suited to be applied to an apparatus provided with, for example, a relatively small-sized liquid crystal display panel.

2. Description of the Related Art

Conventionally, if moving images or static images as a prearranged video program are to be displayed in an image display apparatus such as a monitor image receiver, a picture signal reproducing apparatus, such as a video tape reproducing apparatus or a video disk reproducing apparatus, is connected to the image display apparatus and the video program is reproduced by the reproducing apparatus, thereby displaying the images on the image display apparatus. For this purpose, an apparatus in which an image receiver and a video reproducing apparatus are integrated with each other is put to practical use.

By disposing the image display apparatus connected with the reproducing apparatus (or the apparatus in which the former and the latter are integrated with each other), it is possible to reproduce a video program for explaining or advertising, for example, articles to be sold in stores.

Meanwhile, a picture signal reproducing apparatus, such as a video reproducing apparatus and a video disk reproducing apparatus, is relatively complex in configuration, large in size and complex in mechanism. Due to this, there is a limit to downsizing the apparatus. In case of installing the apparatus in a store or the like, therefore, a relatively large installation space is disadvantageously required.

Furthermore, since the conventional reproducing apparatus in which a video tape or video disk is used as a medium includes a rotary mechanism section, the quality of the apparatus disadvantageously deteriorates with the passage of time. For that reason, it is not always suited to reproduce images continuously for a long time, for example, in a store or on the street.

SUMMARY OF THE INVENTION

It is, therefore, an object of the present invention to provide an image display apparatus suited to reproduce a video program for advertisement purposes or the like.

The present invention comprises a storage medium installation section; a memory section storing image data read out from a storage medium installed in the storage medium installation section; a display section displaying the image data stored in the memory section; and a control section for repeatedly executing display of the image data stored in the memory section.

According to the present invention, the image data read out from the storage medium installed in the storage medium installation section are temporarily stored in the memory section and the stored image data are repeatedly displayed by the display section.

DETAILED DESCRIPTION OF THE PREFERRED EMBODIMENT

Now, one embodiment according to the present invention will be described with reference to the accompanying drawings.

Figure 1:
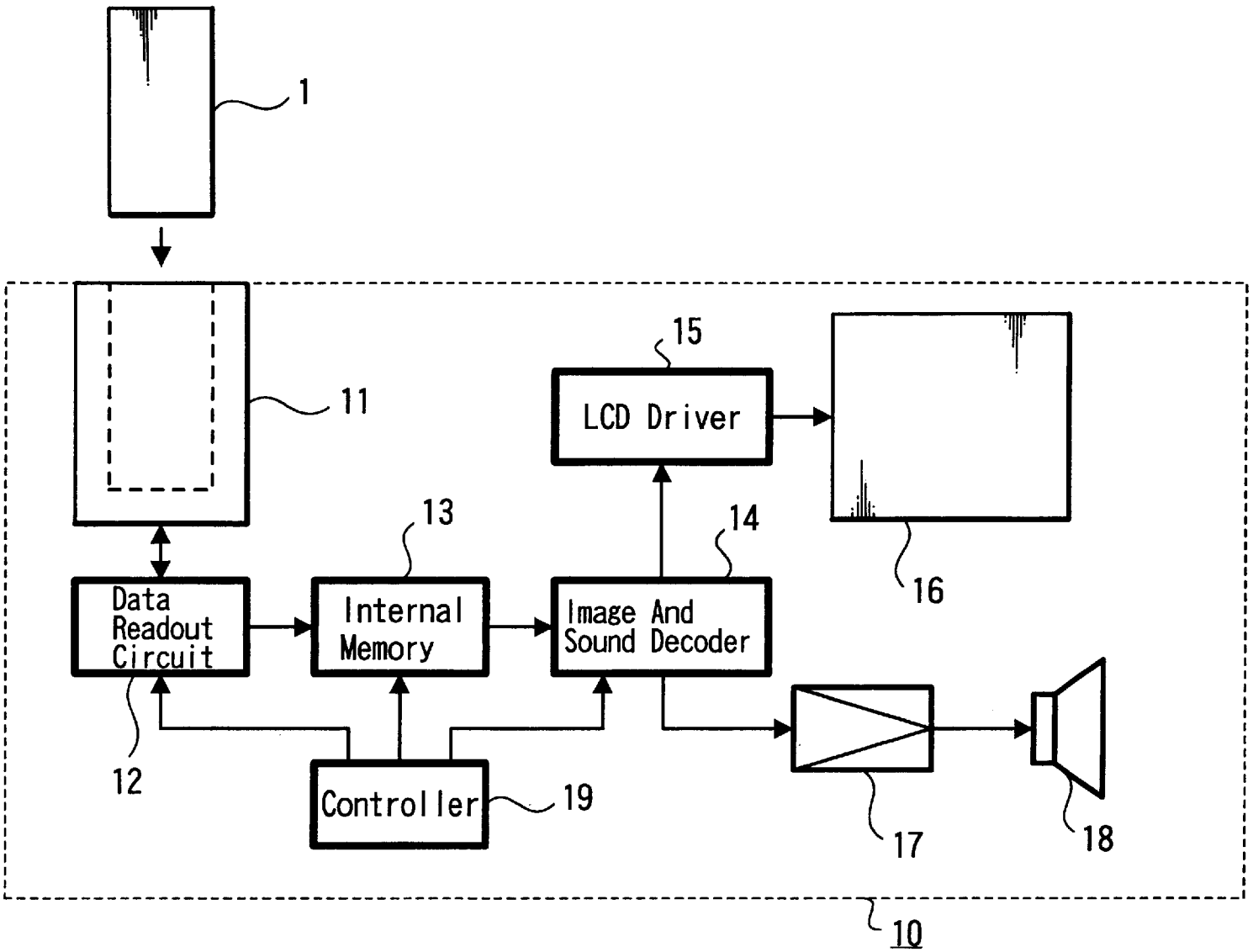
FIG. 1 is a block diagram showing a configuration in one embodiment according to the present invention.
Figure 2:
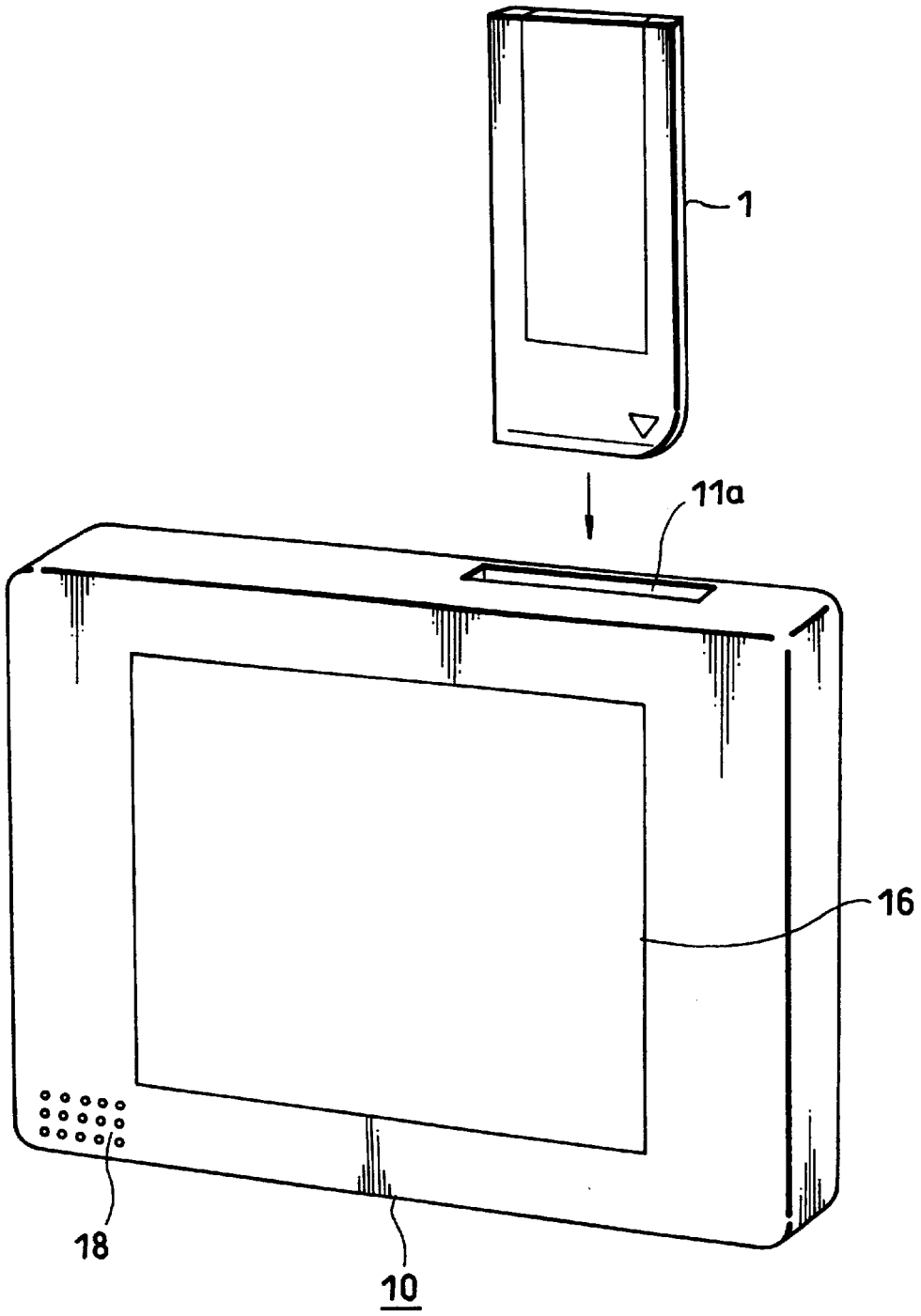
FIG. 2 is a perspective view showing an example of the form of the apparatus in the embodiment according to the present invention.

FIG. 1 is a block diagram showing the configuration of an image display apparatus in one embodiment according to the present invention. FIG. 2 shows an example of the form of the image display apparatus in this embodiment. This embodiment is constituted as an image display apparatus 10 having a relatively small-sized liquid crystal display panel 16 having a length of a diagonal line on a screen of several inches as shown FIG. 2. An insertion section 11*a* for installing an external memory 1 is provided on the upper end portion of this image display apparatus 10. The external memory 1 used herein is a memory apparatus in which a semiconductor memory is contained in a stick-like resin case. For example, a semiconductor memory which can store data of 8M bytes or more is contained in one external memory 1 and terminals (not shown) for writing and reading data are provided at predetermined positions of the memory 1.

Now, the internal configuration of the image display apparatus 10 will be described with reference to FIG. 1. The image display apparatus 10 in this embodiment has an external memory installation section 11 capable of installing the stick-like external memory 1 as already described above. The data stored in the external memory 1 installed in the external memory installation section 11 are read by a data readout circuit 12 and the read data are stored in an internal memory 13 provided within the image display apparatus 10. The data are read from the external memory 1 and stored in the internal memory 13 under the control of a controller 19.

In this embodiment, the data read from the external memory 1 and stored in the internal memory 13 by the data readout circuit 12 are image data and sound data. In this case, the image data and sound data compressed and coded according to, for example, the MPEG1 (Moving Picture Experts Group 1) system are read from the external memory 1 and stored in the internal memory 13. In case of the image data and sound data coded according to the MPEG1 system, if the storage capacity of the external memory 1 is, for example, 8M bytes, it is possible to store at least one-minute moving image data and sound data in the external memory 1.

The internal memory 13 has the same or higher capacity than that of the external memory 1 to be installed in the image display apparatus 10. At the time of storing data from the external memory 1, the controller 19 controls storage operation such that all of the image data and sound data stored in the external memory 1 are stored in the internal memory 13. If it is assumed that the storage capacity of the external memory 1 is 8M bytes, it takes a few minutes to, for example, read all the data stored in the external memory 1 and store them in the internal memory 13. It is noted that it may take less time to transfer the data from the external memory 1 to the internal memory 13 depending on the data transfer rate of the external memory 1.

The image data stored in the internal memory 13 are read out to an image and sound decoder 14 under the control of the controller 19. The decoder 14 conducts image decoding and sound decoding according to the MPEG1 system to the image data, which image data are converted to analog video signals (analog RGB signals in this embodiment) and analog sound signals according to a predetermined system. The analog video signals outputted from the image and sound decoder 14 are supplied to a liquid crystal driver 15, with which images are displayed on a liquid display panel 16.

The analog sound signals decoded and outputted by the image and sound decoder 14 are supplied to a speaker 18 through an amplifier circuit 17 and sound is emitted from the speaker 18. This speaker 18 is placed at a predetermined position on the front surface of the image display apparatus 10 as shown in, for example, FIG. 2 so as to allow a person in the vicinity of the image display apparatus 10 to listen to the emitted sound.

It is noted that the image display apparatus 10 in this embodiment is provided with a power supply circuit (not shown) actuated when commercial AC power of, for example, 100V is inputted thereto. The commercial AC power is rectified and transformed into DC low voltage power, which actuates the image display apparatus 10. In addition, the image display apparatus 10 in this embodiment is not provided with any operation section such as an operation switch. As long as commercial AC power is supplied to the power supply circuit, the images stored in the internal memory 13 are displayed and the sound stored therein is outputted repeatedly. If a new external memory 1 is installed in the external memory installation section 11, image data and sound data are read out from the external memory 1 installed therein and the data stored in the internal memory 13 are updated under the control of the controller 19.

Figure 3:
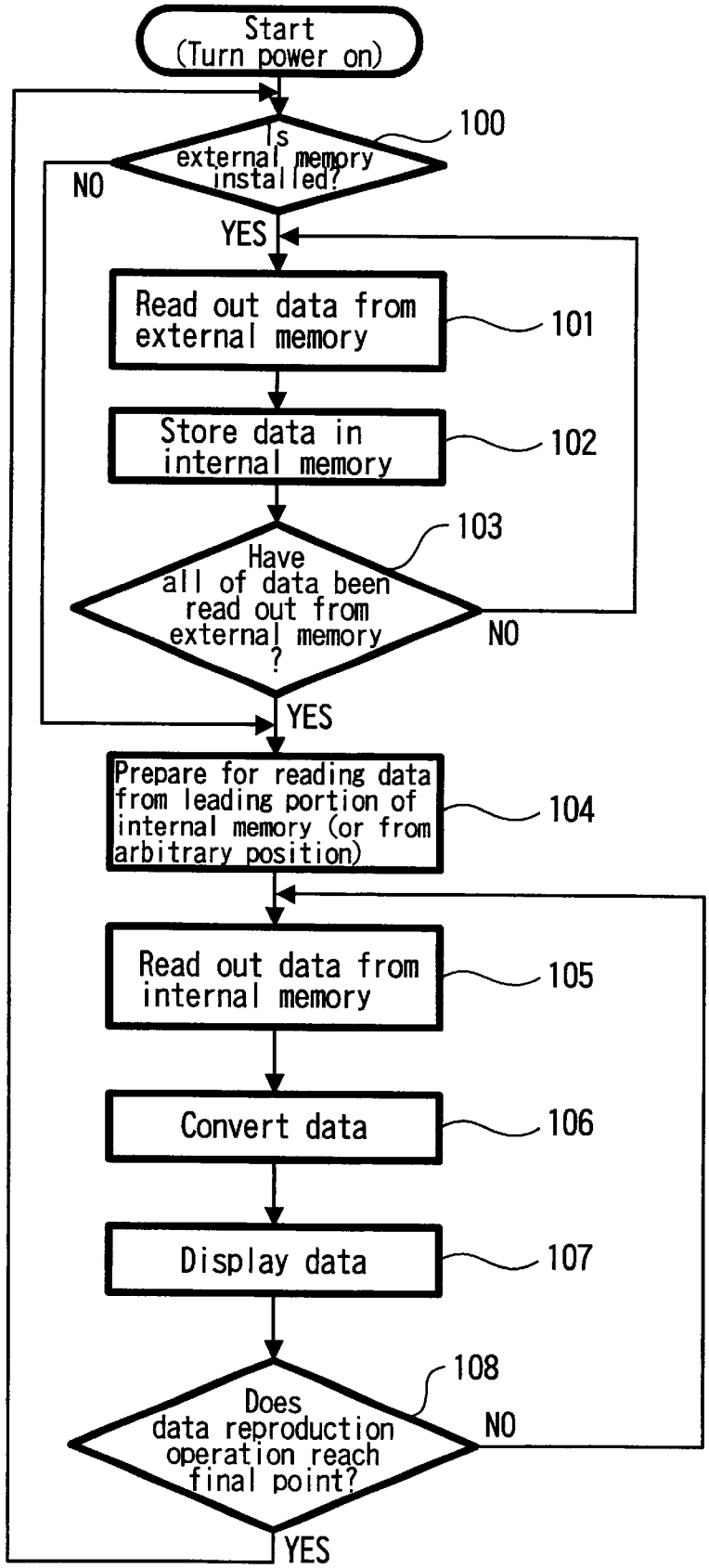
FIG. 3 is a flow chart showing a processing sequence in the embodiment according to the present invention.

Next, description will be given to a processing sequence in case of displaying images using the image display apparatus 10 in this embodiment, with reference to the flow chart shown in FIG. 3. First, if a power plug connected to the power supply circuit of the image display apparatus 10 in this embodiment is connected to an AC power socket, power is supplied to the image display circuit 10 and the internal circuit is thereby actuated, then the controller 19 judges whether or not the external memory 1 is installed in the external memory installation section 11 (in a step 100). If it is judged that the external memory 1 is installed therein, the data stored in the installed external memory 1 are read out by the data readout circuit 12 under the control of the controller 19 (in a step 101) and the read data are stored in the internal memory 13 (in a step 102). At this moment, if data are already stored in the internal memory 13, the stored data are deleted and the data supplied from the external memory 1 are stored in the internal memory sequentially from a leading address thereof. Then, it is judged whether or not all of the data stored in the external memory 1 are read out (in a step 103). If there remain data which have not been read yet, the readout operation in the step 101 and the storage operation in the step 102 are repeatedly executed. Here, the data stored in the external memory and read out therefrom are video program data constituted by one-minute moving image data and one-minute sound data to be reproduced simultaneously with the moving images.

If the controller 19 judges that all of the data stored in the external memory 1 is read out in the step 103 and judges that the external memory 1 is not installed in the step 100, then a preparation for sequentially reading out the image data and sound data stored in the internal memory 13 from the leading address under the control of the controller 19 is made (in a step 104). When the preparation is made, the data stored in the internal memory 13 are read out under the control of the controller 19 (in a step 105) and the read-out data are supplied to the image and sound decoder 14, where the image data and sound data thus read out are decoded (in a step 106). The decoded image data (analog video signals) are supplied to the liquid crystal driver 15 to display one-minute moving images on the liquid display panel 16 (in a step 107). Further, in linkage with the display of the moving images, the sound signals read out from the internal memory 13 and decoded are supplied to the speaker 18 and sound is thereby emitted from the speaker 18.

The controller 19 judges whether or not the operation of reading out data from the internal memory 13 reaches a final point (in a step 108). If the readout operation does not reach the final point, display processings (as well as sound output processing) from the steps 105 to 107 are repeatedly carried out. If it is judged that the readout operation reaches the final point in the step 108, the processing returns to the step 100. Back in the step 100, if it is not detected that a new external memory 1 is installed, the processing moves to the display operation starting at the step 104. If it is detected that a new external memory 1 is installed, the processing will move to the read-in operation from the steps 101 to 103.

Therefore, if the power of the image display apparatus 10 is turned on and the external memory 1 is installed in the image display apparatus 10, then the image data and sound data which constitute a video program are automatically read out from the installed external memory 1 and transferred to and stored in the internal memory 13. As soon as the transfer operation is completed, the stored image data are displayed and the stored sound data are outputted repeatedly from the start to the end. This operation is repeatedly executed until the plug of this apparatus is detached from the power socket.

If a new video program is to be installed in the image display apparatus 10, an external memory 1 which stores image data and sound data of the new video program need only be installed in the apparatus 10. The data are automatically read out from the installed external memory 1 and the data stored in the internal memory 13 are updated. Thereafter, the display of the updated image data and the output of the updated sound data are repeatedly executed.

As seen from the above description, according to the image display apparatus 10 in this embodiment, only by installing a stick-like external memory 1 in the apparatus 10, the image data and sound data stored in the external memory 1 are automatically read out and transferred to the internal memory 13. Then, using the data transferred to the internal memory 13, the display of the images and the reproduction of the sound are repeatedly executed. Thus, it is possible to install an arbitrary video program stored in the external memory 1 into the apparatus 10 and to repeatedly reproduce the data only by installing and taking out the external memory 1. Therefore, if the image display apparatus 10 in this embodiment is disposed, for example, in a store or on the street and the external memory 1 which stores a video program for advertisement purposes or the like to be displayed by the image display apparatus 10 is installed only once into the image display apparatus 10, then the video program is repeatedly reproduced quite conveniently.

In this embodiment, the image display apparatus 10 is not provided with mechanically actuated parts. Due to this, even if the image display apparatus 10 is continuously actuated for a long time, no parts are worn and there is a very little probability that the apparatus may fail. Hence, the image display apparatus 10 in this embodiment is suited to be operated continuously for a long time in a store or on the street.

Further, in this embodiment, the data read out from the external memory 1 are not directly supplied to the decoder but temporarily stored in the internal memory 13. The stored data are supplied to the decoder 14 to thereby display images and reproduce sound. Accordingly, even if the data transfer rate for transferring data from the external memory 1 is limited to a relatively slow rate, it is possible to reproduce the video program consisting of the moving images and sound without causing any problems. For example, even in a case where it takes about three minutes to read out one-minute image data and sound data from the external memory 1, the one-minute image and sound data can be reproduced smoothly by temporarily storing the data in the internal memory 13 and then reading out the data from the internal memory 13. Therefore, it is not necessary to configure the image display apparatus 10 so as to provide the external memory 1 and the out read circuit 12 both enabling high-speed data transfer.

Furthermore, since the data are transferred from the external memory 1 to the internal memory 13 and then reproduced, there is no fear that the external memory 1 is lost by detaching the external memory 1 from the image display apparatus 10 while images and sound are repeatedly reproduced. Also, if many image display devices 10 in this embodiment are prepared and the same video program is to be reproduced by these image display devices 10, only one external memory 1 which stores the video program is prepared and sequentially installed in each of the image display devices 10 thus prepared for the read-in operation, thereby making it possible to reproduce the same video program by all of the image display devices 10. Thus, merely by preparing a single external memory 1, the plural image display devices 10 can reproduce the same video program. Besides, there is no need to connect many image display devices 10 prepared to one another through signal lines or the like.

In the above-stated embodiment, the video program transferred from the external memory 1 and reproduced by the image display apparatus 10 consists of moving image data and sound data. It is also possible that image data consists of one or plural static images. If image data consists of a plurality of static images, it will be sufficient to change the display of the static images one by one at predetermined time intervals. It is also possible to reproduce image data which does not include sound data. In this case, the image display apparatus 10 may be an image data reproduction dedicated apparatus without providing a speaker 18 in the image display apparatus 10.

As described in the above embodiment, if it takes relatively long time to read out image data and/or sound data from the external memory 1 and to write them into the internal memory 13, "Now reading data" or the like may be displayed on the liquid display panel 16 under the control of the controller 19 while the data are being read and "Data read-in is done. Please detach memory." or the like may be displayed thereon when data reading/writing is completed. Graphics instead of characters may be displayed on the liquid display panel 16 in the same manner.

In the above-stated embodiment, no operation switch is provided on the image display apparatus 10. It is also possible to provide a limited operation section such as a volume for sound adjustment. Also, a power switch may be provided thereon. Further, a mode setting switch or the like may be provided so as to read data from the external memory 1 and to start continuous reproducing operation using the switch.

Moreover, the external memory 1 of relatively high storage capacity may be used to store a plurality of video programs and only an arbitrary program among the plural video program may be transferred to the internal memory 13 in the image display apparatus 10 into which the external memory 1 is installed. In this case, if a mode setting switch, for example, is provided on the image display apparatus 10, a program is selected by the operation of the switch by an operator engaging in reading/writing the video program to be transferred.

Additionally, if the internal memory 13 has sufficient storage capacity, all of a plurality of video programs stored in the external memory 1 may be transferred to and stored in the internal memory 13. In this case, which program among the plural video programs stored in the internal memory 13 should be reproduced may be selected by using a mode setting switch or the like. When such plural video programs are stored in the internal memory 13, if data are read out from the internal memory 13 as described with reference to the flow chart shown in FIG. 3 the data may be read from an arbitrary position at which the corresponding video program is stored as indicated by a caption in parentheses in the step 104. If the video program is reproduced up to the last point, data reading may be returned to the original position.

If a plurality of video programs are stored in the internal memory 13 as described above, programs to be read and reproduced from the internal memory 13 may be automatically changed by some sort of settings. Specifically, for example, if the controller 19 of the image display apparatus 10 has a built-in clock function and controls the image display apparatus 10 such that if it is judged that now is in a daytime zone using the clock function, an advertisement program intended for customers who tend to show up in the daytime is reproduced and if it is judged that now is in a nighttime zone, an advertisement video program intended for customers who tend to show up in the nighttime is reproduced. By so controlling, it is possible to appropriately advertise according to the time zone.

Figure 4:
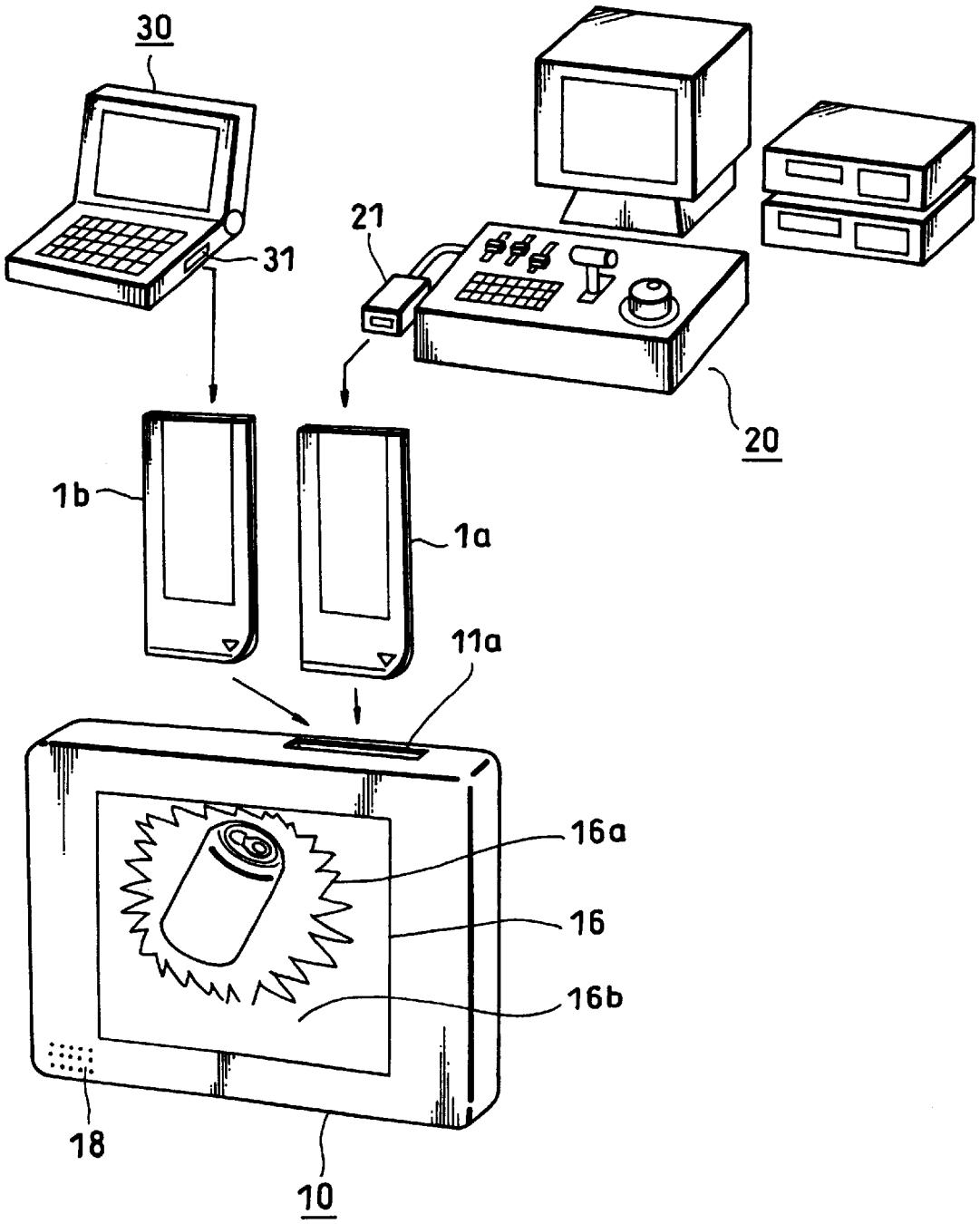
FIG. 4 is an explanatory view showing an example of a system configuration in another embodiment according to the present invention.

Further, if the internal memory 13 of the image display apparatus 10 has a storage capacity enough to store a plurality of image data, the plural image data may be composed and then displayed. As shown in, for example, FIG. 4, an advertisement video program is manufactured by an advertisement video program manufacturer or the like using an edit apparatus 20. An external memory write apparatus 21 connected to the edit apparatus 20 stores the advertisement video program in an external memory 1*a*. The external memory 1*a* is distributed to each shop, at which shop the distributed external memory 1*a* is installed into the external memory insertion section 11*a* of the image display apparatus 10 disposed in the shop and the advertisement video program is acquired by the memory 13 in the image display apparatus 10. If there are characters or images to be composed and displayed together in the video program, the characters and/or images to be displayed are inputted into a personal computer 30 disposed in the shop. Then, an external memory 1*b* prepared by the shop is installed in the external memory slot 31 of the personal computer 30 to cause the inputted data to be stored as image data in the external memory 1*b*.

Thereafter, the external memory 1*b* which stores the image data is taken out from the external memory slot 31 of the personal computer 30 and installed in the external memory insertion section 11*a* of the image display apparatus 10, in which the image data are acquired by the internal memory 13. When the video program is reproduced by the image display apparatus 10, an image 16*a* constituted by the video program which has been read from the external memory 1*a* is displayed on the display panel 16 and, at the same time, an image of, for example, characters 16*b* read from the external memory 1*b* is composed with the image 16*a* for displaying as shown in, for example, FIG. 4. Thus, it is possible to simultaneously display characters and images which the shop desires to particularly advertise. In this embodiment, the characters and the images are simultaneously composed and displayed. It is also possible that two video programs are composed to be displayed by alternately, continuously reproducing the programs so that, for example, the video program read from the external memory 1*a* is reproduced first and then that read from the external memory 1*b* is reproduced. In this case, the video program read from the external memory 1*a* may be, for example, a moving image video program and that read from the external memory 1*b* may be, for example, a static image video program.

Figure 5:
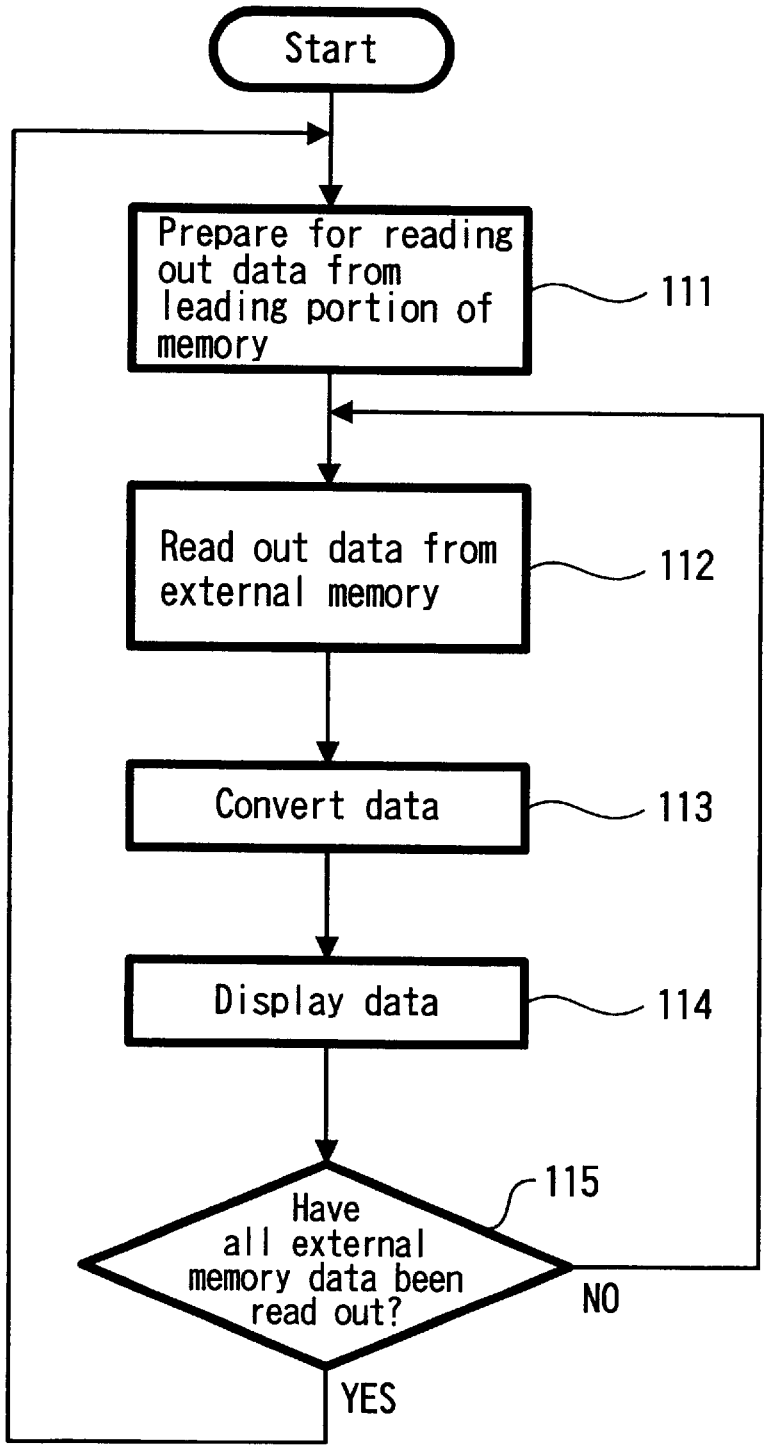
FIG. 5 is a flow chart showing a processing sequence in yet another embodiment according to the present invention.

In the above-stated embodiment, the image data read out from the external memory 1 are temporarily stored in the internal memory and the stored image data are repeatedly reproduced. If the data transfer rate for transferring data from the external memory is fast enough, image data and/or sound data may be directly read out from the external memory and supplied to the decoder, thereby causing the data to be processed for reproduction. The flow chart shown in FIG. 5 indicates this example. In the flow chart, when the power of the image display apparatus is turned on and the operation of the controller starts, a preparation for reading out data from the leading portion of the connected external memory is made (in a step 111). If the preparation has been made, the data are read from the external memory (in a step 112), the data thus read being converted by the decoder (in a step 113) and a display processing for the converted image data and an output processing for the converted sound data being carried out (in a step 114). The processing operations from the steps 112 to 114 are repeatedly carried out until all of the data are read from the external memory. If it is judged that all of the data have been read from the external memory (in a step 115), the processing returns to the step 111, in which step a preparation for reading data from the leading portion of the memory is made again. Through these series of processing operations, the video program is repeatedly reproduced while directly using the data stored in the external memory installed in the image display apparatus.

Furthermore, in the above-stated embodiment, a stick-like memory which contains a semiconductor memory is used as a storage medium to be installed in the image display apparatus. Other external memories such as a memory card compliant with the PCMCIA standard may be used as storage media. It is also possible to install a disk-like storage medium such as an optical disk such as a CD-ROM or a magneto-optical disk into the display apparatus 10 which has a built-in data reading section for reading out stored date from the storage medium and to repeatedly reproduce the image data and/or sound data read out from the disk-like storage medium.

In the above-stated embodiment, description has been given to the image display apparatus for reproducing images and/or sound mainly for the purpose of advertising articles in a store or on the street. Needless to say, the present invention is also applicable to image display devices for other purposes requiring repeated data reproduction as in the case of the embodiment stated above. Regarding the form of the image display apparatus, if the form is limited to that shown in FIG. 2, the present invention is also applicable to various display devices including image display means. For example, display means using a cathode ray tube may be provided in the image display apparatus. Alternatively, the image display apparatus according to the present invention may be used in combination with other devices.

According to a first aspect of the invention, the image data read out from the storage medium installed into the storage medium installation section are temporarily stored in the memory section and the stored image data are repeatedly displayed on the display section. Therefore, by installing the storage medium which stores the image data into the storage medium installation section only once, the images are displayed automatically, repeatedly thereafter, thereby facilitating advertisement using images or the like.

According to a second aspect of the invention, when detecting that the storage medium is installed into the storage medium installation section, the control section controls the image display apparatus to automatically read out the image data stored in the storage medium installed into the storage medium installation section and to store the image data in the memory section. Thus, only by carrying out installation of the storage medium into the installation section, the image data stored in the storage medium are automatically read out and no operation such as readout start operation is required.

According to a third aspect of the invention, when all the image data read out from the storage medium have been stored in the memory section, corresponding display operation is carried out at the display section under control of the control section. Thus, it is possible to judge form the display whether or not the storage medium may be detached from the installation section, thereby making it possible to effectively prevent any failure of reading out data into the memory section.

According to a fourth aspect of the invention, the image data stored in the storage medium installed into the storage medium installation section are moving image data of a predetermined number of programs, and when the moving image data of one program among the predetermined number of programs stored in the memory section have been displayed from start to end, the control section controls the image display apparatus to repeatedly display the same program from the start again. Thus, it is possible to ensure good continuous display of one image program.

According to a fifth aspect of the invention, a first image data and a second image data stored in the storage medium installed into the storage medium installation section are stored in the memory section, and when the image data stored in the memory section are displayed on the display section, the control section controls the image display apparatus such that the first image data and the second image data are composed and then displayed. This facilitates repeatedly displaying the program using the composed images.

According to a sixth aspect of the invention, the image display apparatus further comprises a sound reproduction section; sound data, together with the image data, read out from the storage medium installed into the storage medium installation section are stored in the memory section; and when display operation is executed at the display section, the control section controls the image display apparatus such that the sound data stored in the memory section is reproduced from the sound reproduction section. This facilitates advertisement or the like using images and sound.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An image display apparatus comprising:

a storage medium installation section;

a memory section storing image data read out from a storage medium installed in the storage medium installation section;

a display section displaying the image data stored in the memory section; and a control section for repeatedly executing display of the image data stored in said memory section at said display section;

whereby said apparatus is operable to automatically check whether or not said storage medium is present in said storage medium installation section upon power-up of said apparatus, and if so, is operable to delete at least a portion of any data that was stored in said memory section prior to power-up, and to store data read from said storage medium in said memory section.

2. An image display apparatus according to claim 1, wherein when detecting that the storage medium is installed into said storage medium installation section, said control section controls the image display apparatus to automatically read out the image data stored in the storage medium installed into said storage medium installation section and to store the image data in said memory section.

3. An image display apparatus according to claim 2, wherein when all the image data read out from said storage medium have been stored in said memory section, corresponding display operation is carried out at said display section under control of said control section.

4. An image display apparatus according to claim 1, wherein the image data stored in the storage medium installed into said storage medium installation section are moving image data of a predetermined number of programs, and when the moving image data of one program among the predetermined number of programs stored in said memory section have been displayed from start to end, said control section controls the image display apparatus to repeatedly display the same program from the start again.

5. An image display apparatus according to claim 1, wherein a first image data and a second image data stored in the storage medium installed into said storage medium installation section are stored in said memory section; and when the image data stored in the memory section are displayed on said display section, said control section controls the image display apparatus such that the first image data and the second image data are composed and then displayed.

6. An image display apparatus according to claim 1, wherein the image display apparatus further comprises a sound reproduction section;

sound data, together with the image data, read out from the storage medium installed into said storage medium installation section are stored in said memory section; and when display operation is executed at said display section, said control section controls the image display apparatus such that the sound data stored in said memory section is reproduced from said sound reproduction section.

* * * * *